United States Patent [19]

Brown

[11] Patent Number: 5,000,457

[45] Date of Patent: Mar. 19, 1991

[54] GOLF TRAINING DEVICE

[76] Inventor: Russell M. Brown, 57 Washington St., Natick, Mass. 01760

[21] Appl. No.: 535,624

[22] Filed: Jun. 11, 1990

[51] Int. Cl.[5] ..... A63B 69/36

[52] U.S. Cl. ..... 273/187 B; 273/32 C

[58] Field of Search ..... 237/187 R, 187 A, 187 B, 237/32 C, 35 R, 183 A, 195 R, 195 B, 183 B

[56] References Cited

U.S. PATENT DOCUMENTS

| | | | |
|---|---|---|---|
| 3,384,377 | 5/1968 | Stipp | 273/187 R |
| 3,955,821 | 5/1976 | Spedding | 273/187 B |
| 4,023,810 | 5/1977 | Lorang | 273/187 B |
| 4,917,385 | 4/1990 | Brown | 273/187 B |

*Primary Examiner*—George J. Marlo

*Attorney, Agent, or Firm*—John E. Toupal; Harold G. Jarcho

[57] ABSTRACT

A golf training device including a first platform member having a lower surface adapted for placement on a base surface and an upper inclined surface adapted for supporting one foot of a golfer; a second platform member having an upper surface adapted for engagement by the other foot of the golfer and a lower surface adapted for placement on the base surface; and a connector having one end secured to the first platform member and an opposite end secured to the second platform member, the connector being functional to establish a predetermined spacing between the first and second platform members and an opposite end secured to said second platform member. Each platform member includes an outer portion and an inner portion which is movable downward relative the upper portion, to actuate a resilient snap disc member.

18 Claims, 2 Drawing Sheets

GOLF TRAINING DEVICE

BACKGROUND OF THE INVENTION

This invention relates to a golf training device generally and, more particularly, to a golf training device that assists in the development of a proper golf swing.

Through the years, the golf swing has been widely studied and analyzed to determine techniques that will produce desirable results. These studies have resulted in a number of fairly well known constituents of an effective golf swing. However, converting such findings into repetitive physical performance is not easily accomplished for the average golfer. Consequently, various types of training devices have been developed to assist in the development of a effective golf swing. Typical devices of this type are disclosed, for example, in U.S. Pat. Nos. 4,081,918; 3,275,320; 3,195,891; 3,951,407 and 4,118,034. However, all known prior devices have failed to adequately address the problems of proper foot spacing and weight shift.

The object of this invention, therefore, is to provide an improved training device that will aid in the development of an effective golf swing.

SUMMARY OF THE INVENTION

The invention is a golf training device including a first platform member having a lower surface adapted for placement on a base surface and an upper inclined surface adapted for supporting one foot of a golfer; a second platform member having an upper surface adapted for engagement by the other foot of the golfer and a lower surface adapted for placement on the base surface; and a connector having one end secured to the first platform member and an opposite end secured to the second platform member, the connector being functional to establish a predetermined spacing between the first and second platform members and an opposite end secured to said second platform member. Use of the device facilitates proper foot spacing and weight distribution during the golfer's swing.

According to specific features of the invention, the connector is of adjustable length so as to permit selective variation in the length of the predetermined spacing; the inclined upper surface of the first platform member slopes downwardly toward the second platform member; and the upper surface of second platform member is inclined relative to the lower surface thereof. Those features further refine the ability of the device to insure proper foot spacing and weight distribution.

According to another feature, the invention includes a scale means for determining the length of the predetermined spacing. The scale means simplifies the provision of an optimum spacing between the platform members.

According to yet another feature, the device further includes an indicator coupled to the second platform member and adapted to produce an indication in response to the application of a given level of force to the upper surface thereof. The indicator provides the golfer with assurance that a proper swing follow-thru has been completed.

According to a further feature the device also includes an indicator coupled to the first platform member and adapted to produce an indication in response to a substantial change in the forces applied thereto. The indicator for the first platform member provides the golfer with an alarm in response to an improper weight shift during a swing.

According to still further features the indicators comprise means for producing an audible indication in response to changes in the application of the given forces. The audible indicators provide indications without distraction.

The invention further encompasses a golf training method including the steps of providing a platform member comprising an upper surface portion for supporting the foot of a golfer; coupling to the platform an indicator for providing an indication in response to the application of a given level of force to the upper surface portion; positioning the platform member under the rear foot of a golfer addressing a golf ball with said upper surface portion supporting the outer portion of the foot; and denoting during the golfer's swing at the golf ball an indication by the indicator in response to a shift of the golfer's weight toward the outer portion of the foot.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
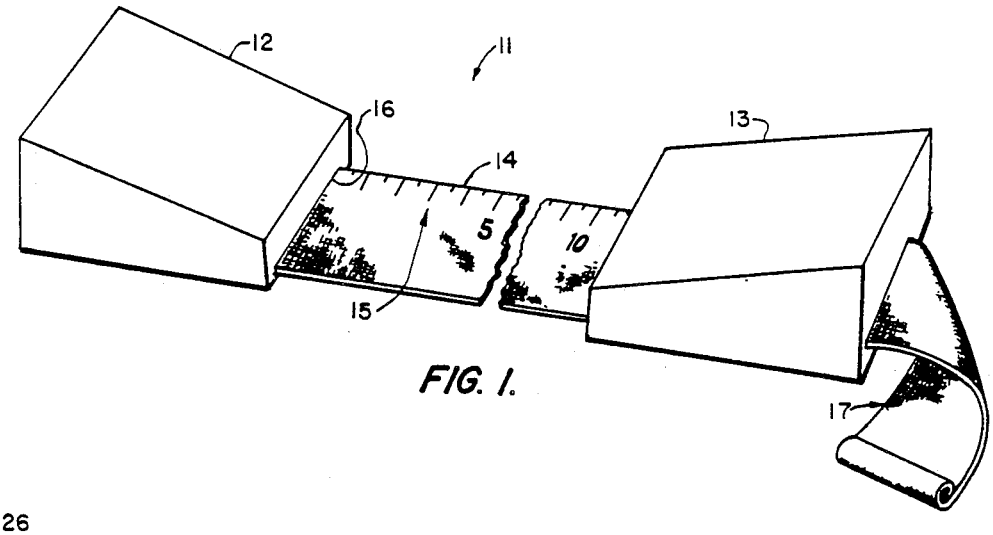
FIG. 1 is a perspective view of a golf training device according to the invention.

A golf training device 11 includes a first platform member 12 secured to a second platform member 13 by a connector belt 14. An inner end of the member 12 is fixed to one end 16 of the connector belt 14, an opposite end 17 of which extends slidably through the second platform member 13. The spacing between the first and second platform members 12, 13 can be selectively adjusted to provide a predetermined spacing therebetween as indicated by indicia 15 on the connector belt 14.

Figure 2:
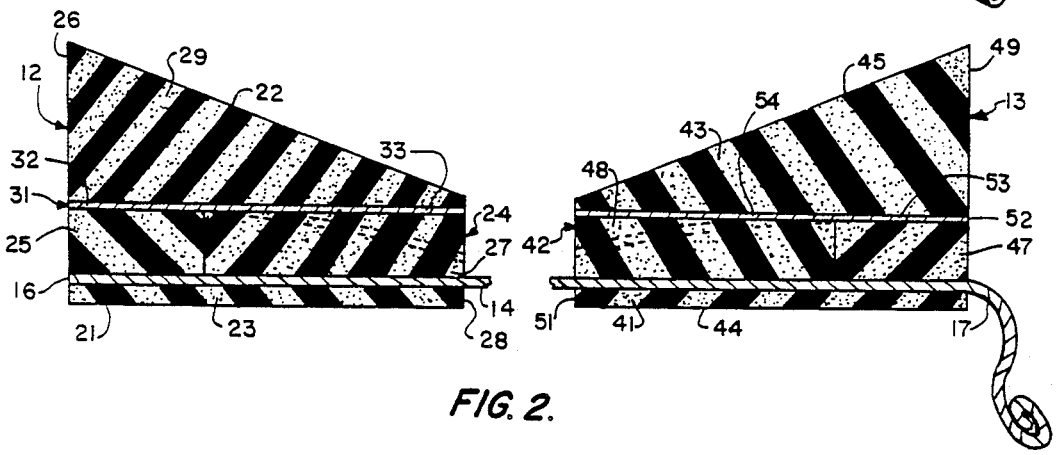
FIG. 2 is a cross-sectional view of the device shown in FIG. 1.

As shown in FIG. 2, the first platform member 12 is a composite member having a planar bottom surface 21 adapted for placement on a suitable base surface such as the ground and an upper inclined surface 22 sloping downwardly toward second platform member 13. The one end 16 of the belt 14 is fixed between a rigid bottom portion 23 and an intermediate portion 24 of the member 12. Forming the intermediate portion 24 is a rigid portion 25 extending from an outer surface 26 of the first platform member 12 and a resilient front portion 27 extending from an inner surface 28 of the first member 22 and joined to the rigid portion 25. A resilient top portion 29 of the first platform member 12 is formed by a piece9 of triangular cross-section that forms the inclined upper surface 22. Retained between the piece 29 and the intermediate portion 24 is a snap disc 31 having a fixed portion 32 supported by the rigid portion 25 and a deflectable portion 33 supported by the resilient portion 27 of the intermediate portion 24.

As also shown in FIG. 2, the second platform member 13 also is a composite member having a rigid base portion 41, an intermediate portion 42 and a resilient upper portion 43. The lower portion 41 defines a planar lower surface 44 adapted for placement on a base surface such as the ground and the upper portion 43 defines an inclined upper surface 45 sloping downwardly towards the first platform member 12. Slidably retained between the lower portion 41 and the intermediate portion 42 is the opposite and 17 of the belt 14 that can be slid therebetween to vary the spacing between the first and second platform members 12, 13. The intermediate portion 42 includes a rigid portion 47 extending from an outer surface 49 of the second platform member 13 and a resilient portion 48 extending from an inner surface 51 thereof. Retained between the intermediate portion 42 and the upper portion 43 is a snap disc 52 having a fixed portion 53 supported by the rigid portion 47 and a deflectable portion 54 supported by the resilient portion 48 of the intermediate block portion 42.

During use of the device 11 the second platform member 13 is first slid upon the end 17 of the belt 14 to provide a spacing between the members 12 and 13 substantially equal to the width of a user's shoulders. The members 12, 13 then are placed upon the ground and the portion of the belt 14 therebetween fully extended to establish the selected shoulder width. A preferred disposition aligns the members 12, 13 and connecting belt 14 with the direction in which a golf ball is to be propelled. For a right handed golfer, a stance is assumed with the right or rear foot supported on the upper surface 22 of the first platform member 12 and the left or front foot supported on the upper surface 45 of the second platform member 13. During the golfer's backswing the inclined upper surface 22 of the first member 12 prevents an outward shifting of the golfer's weight and thereby both insures better balance and prevents over swinging. Subsequently, during the golfer's foreswing as the weight shifts from the right or back to the left or front foot on the upper inclined surface of the second platform member 13 which again prevents undesirable outward shifting of body weight. In addition, a desirable weight shift and downward thrust onto the golfer's left front leg induces a force of the second block member 13 that deforms resilient portion 48 of the intermediate block portion 42 and deflects the deflectable end 54 of the snap disc 52 to produce an audible snapping sound. That sound indicates a satisfactory conclusion of the golf swing.

Also occurring during the above described sequence is a deflection of the deflectable end 33 of the snap disc 31 in the first platform member 12. Deflection is caused by the force produced on the upper surface 22 of the block member 12 by the golfer's right rear foot. In the event of undesirable over swinging during the golfer's foreswing that is accompanied by weight shift on the golfer's right rear foot or a complete movement thereof off the upper surface 22 of the first platform member 12, an audible indication is provided by the snap disc 31. In response to a reduction in force on the upper surface 22 of the block member 12 the deflectable portion 33 of the snap disc 31 will snap back into its original position producing a snapping sound indicative of an improper swing. Obviously, the above described operation is performed in a reverse manner by a left-handed golfer.

Thus, the device 11 is a useful golf training device that can assist in correction of numerous golf swing faults. Proper golfer orientation is provided by alignment of the first and second platform members 12, 13 and belt 14 in the direction of desired ball movement, proper foot spacing is provided by adjustment of the second platform member 13 on the belt 14 and the inclined surfaces 22, 45 of, respectively, the first platform member 12 and the second platform member 13 insure proper weight distribution during both back and foreswings. In addition, the snap disc 52 in the second platform member 13 provides an audible positive feedback in response to proper conclusion of a golf foreswing while the snap disc 31 in the first platform member 12 provides an audible indication of undesirable outward weight shift from the golfer's back foot during a foreswing.

Figure 3:
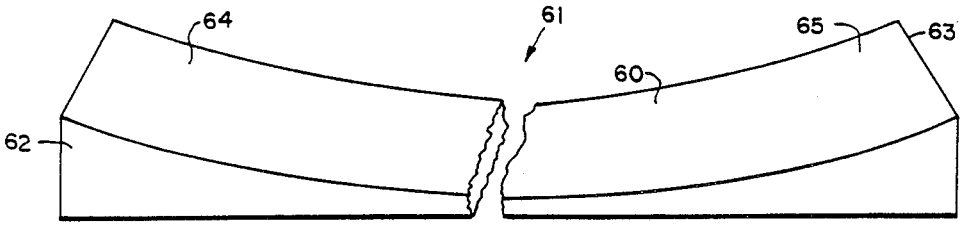
FIGS. 3 and 4 are perspective and front views of another golf training device embodiment according to the invention.
Figure 4:
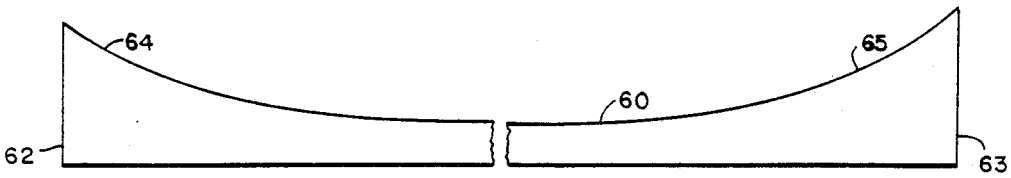

Illustrated in FIGS. 3 and 4 is another golf training device embodiment 61 of the invention. The embodiment 61 includes a first platform member portion 62 joined to a second platform member portion 63 by an elongated intermediate portion 60. The first platform member portion 62 includes an inclined upper surface 64 sloping downwardly toward the second platform member portion 63 which similarly includes an inclined upper surface 65 sloping downwardly toward the first platform member portion 62. The device 61 is an integral unit formed, for example, of plastic by an injection molding process or cut out of a suitable block of wood. The use of the embodiment 61 is similar to the embodiment 11 shown in FIGS. 1 and 2. No provision is made, however, for adjustment in the spacing between the first and second block member portions 61, 63 so that individual units with intermediate connector portions 60 of different lengths would be provided to accommodate golfers of various shoulder width.

Figure 5:
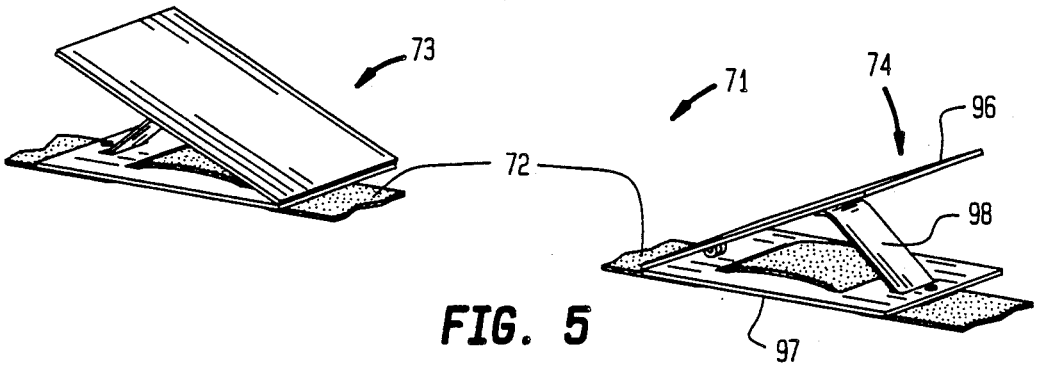
FIGS. 5 and 6 are perspective and cross-sectional views showing another embodiment of the invention.
Figure 6:
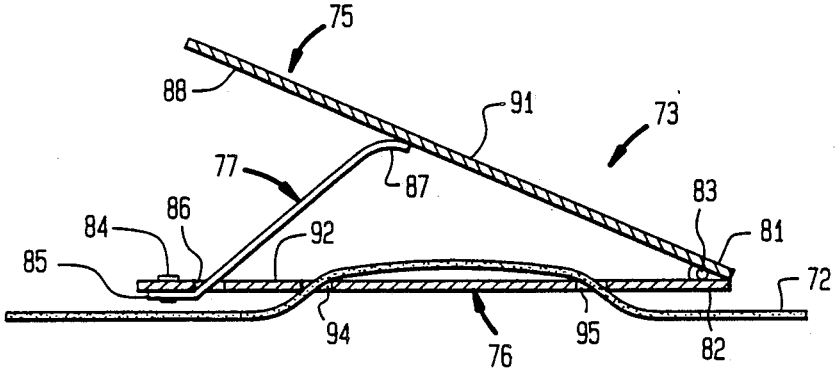

Illustrated in FIGS. 5 and 6 is another golf training embodiment 71 of the invention. An elongated flexible belt 72 extends between and is secured to a first platform member 73 and a second platform member 74. As shown in FIG. 6, the first platform member 73 includes an upper plate 75, a lower plate 76 and a snap disc 77. One end 81 of the upper plate 75 is attached to one end 82 of the lower plate 76 by a hinge pin 83. Attached to an opposite end of the bottom plate 76 by a rivet 84 is one end 85 of the snap disc 77 which extends through a slot 86 in the lower plate 76. An opposite cantilevered end 87 of the snap disc 77 engages an intermediate portion of a lower surface 88 of the upper plate 75. The snap disc 87 retains the upper plate 75 in a position with its upper surface 91 inclined relative to an upper surface 92 of the lower plate 76 and sloping toward the second platform member 74. One end of the belt 72 is slidably retained within slots 94, 95 in the lower plate 76 so as to facilitate adjustment in the length of the belt 72 extending between the first and second platform members 73, 74. The second platform member 74 including a second upper plate 96, a second lower plate 97 and a second snap disc 98 is identical to the first platform member 73.

The use of the embodiment 71 is the same of that described above for the embodiment 11. A golfer adjusts the belt 72 so as to provide a comfortable spacing between the first and second platform members 73, 74. Next, the golfer assumes a stance with one foot resting on a upper surface of each of the first and second platform members 73, 74. In response to a weight shift that applies a predetermined force to the upper plate 75 of the first platform member 73, the snap disc 87 is resiliently deflected to produce an audible indication. Similarly, in response to a weight shift that produces the application of a given force on the second platform member 74, the second snap disc 98 is resiliently deflected to produce an audible indication.

Obviously, many modifications and variations of the present invention are possible in light of the above teachings. It is to be understood, therefore, that the invention can be practiced otherwise than as specifically described.

What is claimed:

1. A golf training device comprising:

a first platform means having an upper surface adapted for supporting one foot of a golfer and a lower surface adapted for placement on a base surface, said upper surface of said first platform means being inclined relative to said first lower surface thereof;

a second platform means having an upper surface adapted for engagement by the other foot of the golfer and a lower surface adapted for placement on the base surface; and connector means comprising an elongated flexible belt having one end secured to said first platform means and an opposite end secured to said second platform means, said belt being adjustable in length to establish a predetermined spacing between said first and second platform means.

2. A golf training device according to claim 1 wherein said inclined upper surface of said first platform means slopes downwardly toward said second platform means.

3. A golf training device according to claim 2 wherein said upper surface of second platform means is inclined relative to said lower surface thereof.

4. A golf training device according to claim 3 wherein said inclined upper surface of said second platform means slopes downwardly toward said first platform means.

5. A golf training device according to claim 4 including scale means for determining the length of said spacing.

6. A golf training device according to claim 5 wherein said scale means comprises measuring indicia imprinted on said connector means.

7. A golf training device according to claim 4 wherein said elongated belt is slidably secured to at least one of said first and second platform means.

8. A golf training device according to claim 1 including indicator means coupled to said second platform means and adapted to produce an indication in response to the application of a given level of force to said upper surface thereof.

9. A golf training device according to claim 1 wherein said inclined upper surface of said first platform means slopes downwardly toward said second platform means.

10. A golf training device according to claim 9 wherein said upper surface of second platform means is inclined relative to said lower surface thereof and wherein said inclined upper surface of said second platform means slopes downwardly toward said first platform means.

11. A golf training device according to claim 10 including a first indicator means coupled to said first platform means and adapted to produce an indication in response to the application of a predetermined level of force to said upper surface thereof, and a second indicator means coupled to said second platform means and adapted to produce an indication in response to the application of a given level of force to said upper surface thereof.

12. A golf training device according to claim 11 wherein said first platform means comprises a first upper plate defining said upper surface thereof, a first lower plate defining said lower surface thereof, and first hinge means connecting one end of said first upper plate to one end of said first lower plate; and said first indicator means comprises a first snap disc member having one end secured to said first lower plate and a cantilevered opposite end disposed for engagement by said first upper plate and adapted to produce a sound in response to downward movement thereof.

13. A golf training device according to claim 12 wherein said second platform means comprises a second upper plate defining said upper surface thereof, a second lower plate defining said lower surface thereof, and a second hinge means connecting one end of said second upper plate to one end of said second lower plate; and said second indicator means comprises a second snap disc member having one end secured to said second lower plate and a cantilevered opposite end disposed for engagement by said second upper plate and adapted to produce a sound in response to downward movement thereof.

14. A golf training device according to claim 13 wherein said one ends of said first and second disc members are secured to portions of said lower plates spaced substantially from said one ends thereof, and said cantilevered ends are disposed for engagement by intermediate portions of said upper plates.

15. A golf training device according to claim 14 wherein said elongated belt is slidably secured to at least one of said first and second lower plates.

16. A golf training device according to claim 15 wherein each of said lower plates defines a pair of spaced apart slots, and said belt is slidably retained within each said pair of slots.

17. A golf training device according to claim 13 wherein said elongated belt is slidably secured to at least one of said first and second lower plates.

18. A golf training device according to claim 17 wherein said belt is slidably secured to both said first and second lower plates.

* * * * *